United States Patent [19]

Kasai

[11] Patent Number: 4,874,928

[45] Date of Patent: Oct. 17, 1989

[54] A HEATING APPARATUS FOR AUTOMATICALLY DISTINGUISHING THE CONDITION OF FOOD TO BE REHEATED

[75] Inventor: Isao Kasai, Nara, Japan

[73] Assignee: Matsushita Electric Industrial Co., Ltd., Osaka, Japan

[21] Appl. No.: 188,539

[22] Filed: Apr. 29, 1988

[30] Foreign Application Priority Data

Apr. 30, 1987 [JP] Japan ..... 62-106631
Jul. 20, 1987 [JP] Japan ..... 62-180466

[51] Int. Cl.[4] ..... H05B 6/68

[52] U.S. Cl. ..... 219/492; 219/518; 219/10.55 B; 219/10.55 M; 99/325

[58] Field of Search ..... 219/10.55 B, 10.55 E, 219/10.55 R, 10.55 M, 518, 509, 489, 492; 99/325, 326, 327, 328, 451, DIG. 14

[56] References Cited

U.S. PATENT DOCUMENTS

Re. 31,094 11/1982 Kobayashi et al. ..... 219/10.55 B
4,336,433 6/1982 Yokozeki ..... 219/10.55 B
4,481,394 11/1984 Tanabe ..... 219/10.55 B
4,488,025 12/1984 Tanabe ..... 219/10.55 B
4,590,350 5/1986 Ueda ..... 219/10.55 B
4,599,503 7/1986 Ueda ..... 219/518 X
4,754,112 6/1988 Hiroshima ..... 219/10.55 B

FOREIGN PATENT DOCUMENTS 0166997 1/1986 European Pat. Off. .

*Primary Examiner*—Philip H. Leung
*Attorney, Agent, or Firm*—Wenderoth, Lind & Ponack

[57] ABSTRACT

A heating apparatus is provided with the gas sensor for detecting gas or steam generated from an object to be heated and a weight sensor for detecting the weight of the object to be heated. The signal level of the gas sensor indicates whether the change in the amount of the gas or the steam in the exhaust guide portion is a predetermined value of gas or steam generated from the object, to determine the kind and condition of the object to be heated. Also, change in the signal level of the gas sensor is compared to the predetermined value at a detection time period which is based on the weight of the food detected by the weight sensor, to decide whether to continue or stop heating.

9 Claims, 14 Drawing Sheets

$$K \backsim \frac{T_2 - T_1}{T_2}$$

A HEATING APPARATUS FOR AUTOMATICALLY DISTINGUISHING THE CONDITION OF FOOD TO BE REHEATED

BACKGROUND OF THE INVENTION

1. Field of the Invention

The present invention relates to an automatic heating apparatus employing a gas sensor and a weight sensor to detect the condition of an object to be heated.

2. Description of the Prior Art

Conventionally, such an automatic heating apparatus that is designed to automatically control the heating time of food has been widely put into practical use. An automatic electronic oven is one example of such an apparatus, and is highly regarded in terms of convenience, and accordingly occupies a considerably large share of the oven market. The above-described automatic heating apparatus embodies various types such as one equipped with a gas sensor which reacts to steam or various kinds of gases generated during heating of the food, or an infrared ray sensor for detecting the surface temperature of the food, or a thermistor for detecting the temperature of the air flowing in and out of a heating chamber. The heating operation is designed depending on the kind, condition or the like of the food to be heated in any one of the above-described types. For example, in the heating apparatus marketed during the first stages of development of these apparatus, several select keys are employed in general for selecting the reheating operation. A representative example is U.S. Pat. No. Re. 31,094. FIG. 1 is a perspective view of such a prior art apparatus as referred to above. FIG. 2 is a front view of an operating panel of the prior art apparatus of FIG. 1. In the heating apparatus of FIG. 1, a door member 2 is so provided as to be freely opened or closed in the front face of a main body 1. The apparatus has many select keys 4 arranged on an operating panel 3 in the front face of the main body 1 for selecting the type of heating operation depending on the temperature condition or the kind of food. In the category of food for reheating, five select keys, namely, for "cold boiled rice", "soup", "curry/stew", "frozen boiled rice" and "frozen curry" are provided. The reason for the provision of the five select keys resulted from the fact that, if the heating operation were stopped at the time when the steam or gas was generated from the food, or when the surface temperature of the food had reached a predetermined temperature, some kinds of food would not have been heated sufficiently at the center thereof, requiring further heating, the time for which however varies for each type of food. FIG. 3 shows the relationship of the heating time and the amount of the steam generated from the food as detected by the gas sensor. In the graph of FIG. 3, T1 is the time prior to a first detection point when a predetermined amount of steam is detected by the gas sensor. When cold boiled rice is reheated, it is good to stop the heating thereof at a time at which the generation of steam is detected. In the case of reheating soup, it is still lukewarm at T1 without being heated further for an additional time K1×T1, K1 being constant and selected to be 0.1–0.5 from experience. In the case of jelly-like curry or stew, it is necessary to heat the same over a time K2×T1 in addition to the time T1, K2 being 0.3–0.8. For frozen rice with little moisture which is obtained by freezing cold boiled rice, it is necessary to reduce the heating caloric value from the time point T1 when the steam is detected, and heat the rice over a time K3×T2 in addition to the time T2 prior to the second detection point when a predetermined amount of steam is detected from the food after the entirety of the frozen food is defrosted, K3 being 0.01–0.5. Also, for frozen curry with much moisture, which is obtained by freezing cold curry, it can be heated to a suitable temperature if the curry is fully defrosted, with the heating caloric value reduced from the time point T1, and is further heated over a time K4×T2 after the time point T2 when the predetermined amount of steam is detected, K4 being 0.3–2.0. The reason why the value of K is different for each food is that the steam is generated in a different way from each food, and the reason why the heating caloric value is or is not reduced during heating is that the initial temperature is different in each food, that is, the degree to which the food is frozen is different for type of food. Since the heat conductivity and the convection property are different in each type of food, and the steam generation starts locally in some foods, the value of K is different for every type food.

Consequently, a user of the prior art heating apparatus has been obliged to select the key most suitable for the food to be heated from among several select keys. However, since only 5–6 menus can be provided at most on the keyboard of the apparatus, the user is required to look into a cookbook or the like whenever he or she does not know whether the food which is not indicated on the keyboard is able to be automatically heated and cooked. For example, when the user wishes to reheat macaroni, the user may not be able to find out which key he or she should select. A market survey reveals, accordingly, that the automatic heating function is not utilized at a high rate although users do make use of the reheating operation at a high rate. This is because it is quite a burden for the user to select one key from among many select keys.

According to the above-described heating apparatus marketed in the first stage of development, reheating is performed through the selection of a key from among many select keys which are arranged in accordance with the kind and the initial temperature of the food to be heated. On the other hand, according to the heating apparatus marketed in the second stage of development of these types of apparatus, foods are classified into the group of frozen foods and the group of cold foods and two select keys are respectively provided for reheating frozen foods and cold foods. The reheating operation in such a heating apparatus will be described hereinbelow with reference to an operating panel of the apparatus shown in FIG. 4.

The heating apparatus is provided with a gas sensor and a weight sensor which detects the weight of the food to be heated, such as disclosed in U.S. Pat. No. 4,590,350. For heating the group of cold foods, the threshold value for detection of the gas sensor is set high, and at the same time, the heating time is calculated in accordance with the detected total weight of the food (including the packaging). The heating apparatus is so arranged that the gas sensor and the weight sensor are controlled a parallel relation. Accordingly, food having a small K value is heated on the basis of the weight detected by the weight sensor, while food having a large K value is heated on the basis of the elapsed and the amount of moisture as detected by the gas sensor.

Meanwhile, for heating the group of frozen foods with the heating apparatus, the heating caloric value is changed after the first detection point when the steam is detected as being generated from the food, and then heating is continued.

Thereafter, the ratio of the time before the second detection point when it is detected that the generated amount of steam has reached a predetermined amount with respect to the time lag between the first detection point and the second detection point is obtained. And an additional heating factor K corresponding to the calculated time ratio is obtained. When the K value is small, the food is determined to have a relatively low amount of moisture and is easy to get warm, and therefore the additional heating time K×T is short. On the contrary, when the K value is large, the food to be heated is regarded as full of moisture and hard to warm, and so a long additional heating time K×T is established.

How the heating of the cold food group is carried out in the prior art apparatus will be explained with reference to the graph of FIG. 5 which shows the amount of steam detected by the gas sensor in accordance with the lapse of the heating time. Three points with the mark * are the conventional detection points of FIG. 3, while the "reheat" point is a new detection point disclosed in U.S. Pat. No. 4,590,350. The new detection point has a considerably higher threshold value as compared with the conventional ones, and is defined approximately at the center of the conventional finishing points for "soup" and "curry/stew". "Soup" is a little hotter at the new detection point, and "curry/stew" which is in a gelled state is a little lukewarm at the new detection point, which is no inconvenience in practice use, though. On the contrary, however, "cold boiled rice" is considerably overheated at the new detection point and is turned into solid rubber-like material. Therefore, the weight sensor is employed so as to prevent cold boiled rice or some kinds of soups from being overheated. The new detection points of the gas sensor are plotted in FIG. 6 for each menu. In the above-described heating apparatus, cold boiled rice and consommé are overheated, while curry and noodles are finished in an almost favorable condition. Therefore, the overheating of the cold boiled rice and consommé is prevented in the following manner. The total weight (including the weight of a container) of the food is measured by the weight sensor, and the necessary cooking time for the food is calculated on the basis of the detected total weight of the food. The measurement of the weight by the weight sensor is controlled in parallel (by OR logic) with the detection of the amount of gas detected by the gas sensor. At this time, if a calculation formula is suitably selected, only cold boiled rice, consommé or milk that would be overheated if the heating thereof were based solely on the detection of the amount of gas by the gas sensor can be heated on the basis of the measurement of the weight by weight sensor. This is because, since cold boiled rice, consommé or milk is generally put in, for example, a rice bowl or a teacup having a large capacity (150–400 cc) in comparison with its own weight (70–200 g), the weight of the food with respect to the total weight is large. Accordingly, the detection of the amount of gas by the gas sensor when heating the cold boiled rice, consommé or milk is delayed as compared with the heating of noodles or curry/stew if they have the same total weight, and therefore the cooking time of the cold boiled rice, consommé or milk is as shown in FIG. 6. Thus, the cold boiled rice, consommé or milk can be automatically cooked on the basis of the detection of the weight thereof by the weight sensor.

From experiments, it has been found that the above-mentioned calculation formula can be expressed as a linear function To=AWo wherein constant A is preferably 0.3 or so (To (second) and Wo (g)). Cold boiled rice, consommé or milk is well heated after the weight time expressed above. Moreover, when curry, noodles or a small amount of cooked vegetables (½ cup) are heated over the weight time, the result is better than when they are heated on the basis of the detection of the amount of gas by the gas sensor. That is, the weight sensor is effective to improve a poor correspondence between the volume of the food and the amount of gas sensed by the gas sensor (to prevent the heating from being stopped too late).

Hereinafter, how the group of frozen foods is heated in the prior art devices will be described.

The food to be heated is started to be heated by a large amount of power as shown in FIG. 7. As the heating of the food proceeds, the power is lowered as shown in FIG. 7(*a*). The food is roughly heated initially with the high power output. Then, when the gas sensor detects a small amount of steam or gas generated from the food, that is, at the first detection point, the power for heating the food is switched to low. The reason why the heating power is switched from high to low is that, since the food is roughly heated initially with the high power output, only a limited part of the food is heated which suddenly discharges a great amount of steam. Therefore, a large part of the food remaining has been sufficiently heated at the second detection point. Namely, heating is interrupted earlier. Accordingly, by changing the heating power from high to low, the heat of the limited part of the food which has already been heated can be transmitted to other parts of the food. Thus, while heating is continued, the temperature of all of the food is raised, to suddenly increase the amount of steam or gas per unit time at the time detection point. When the signal level of the gas sensor at the second detection point is obtained in accordance with increase of the amount of steam generated from the food, an additional heating time K×T2 after the second detection point is obtained based on the ratio of the time from the start of heating to the second detection point with respect to the time lag between the first detection point and the second detection point. Heating is further continued for the additional heating time and is then stopped. During the time lag between the first detection point and the second detection point, the food which has been partly heated is entirely warmed, and accordingly, the time lag between the first detection point and the second detection point reflects the conduction speed of the heat thus representing the type of the food. On the other hand, the time from the start of heating to the second detection point indicates the entire volume of the food. Therefore, the food can be expressed as a general characteristic value indicative of the type and volume of the food by the above-mentioned time ratio. If heating is continued after the second detection point for an additional heating time corresponding to the product K×T2 of the additional heating time factor K which is obtained on the basis of the characteristic value and the time period T2 from the start of heating to the second detection point, the food can be heated in a manner suitable for the type and volume thereof.

The foregoing description is related to reheating of the cold food group and the frozen food group in the heating apparatus described above. As shown in FIG. 4, two select keys are alloted in the prior art heating apparatus for respectively reheating the cold foods and the frozen foods. Meanwhile, since there are frozen foods which can be eaten raw if they are only defrosted, the select keys may include both a "defrost" key and a "defrost-reheat" key. However, this brings about a dangerous possibility of an erroneous operation by the user. From the above viewpoint, one select key is desirable for reheating all groups of foods.

SUMMARY OF THE INVENTION

Accordingly, an essential object of the present invention is to provide an automatic heating apparatus having one single select key for the reheating operation which can be used to reheat food classified in both the cold food group and the frozen food group, thereby contributing to the convenience of the apparatus.

In accomplishing the above-described object, according to the present invention, the automatic heating apparatus is provided with a gas sensor and a weight sensor for detecting the weight of the food to be heated. The detection time period corresponding to the total weight of the food (including the packaging) detected by the weight sensor is calculated, and it is determined whether or not the steam generated from the food, detected by the gas sensor before the detection time point, reaches a predetermined amount. When the predetermined amount of the steam is generated before the detection time point, the food to be heated is judged to be cold food and heating is continued in a manner appropriate for cold food. On the contrary, when the predetermined amount of the steam is not generated before the detection time point, the food is determined to be in the frozen food group, and heating is continued in a manner appropriate for the frozen food group. Accordingly, reheating of the cold food group and the frozen food group is automatically controlled in the automatic heating apparatus of the present invention.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE PREFERRED EMBODIMENT

Figure 1:
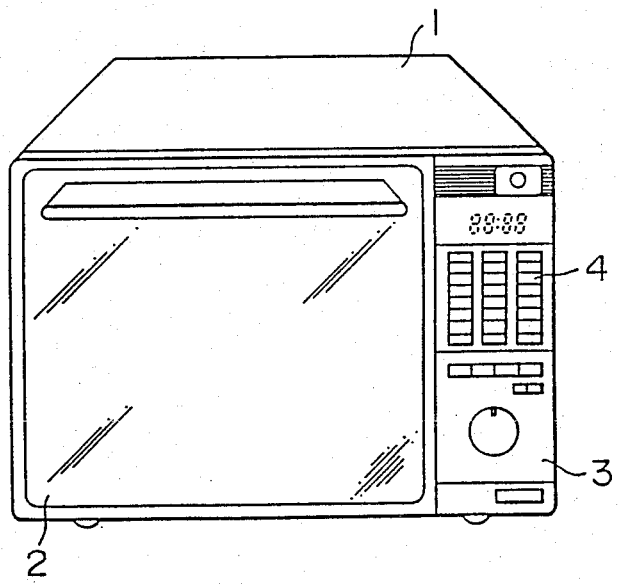
FIG. 1 PRIOR ART
FIG. 1 is a perspective view of a main body of an automatic heating apparatus of the prior art.
Figure 2:
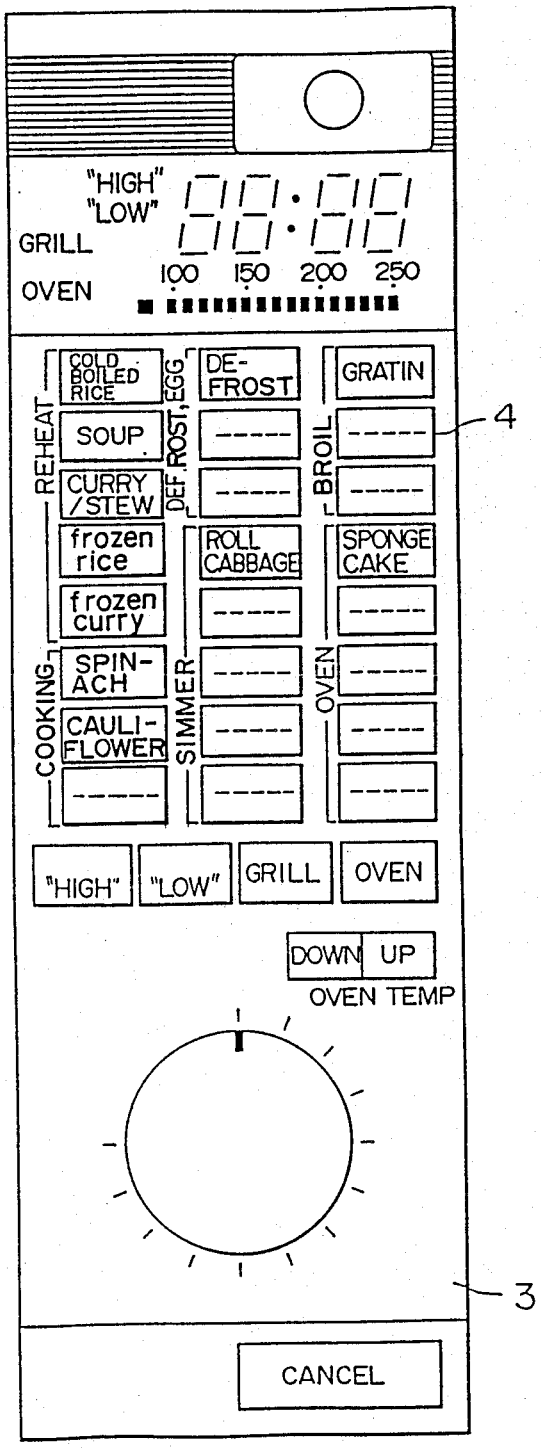
FIG. 2 PRIOR ART
FIG. 2 is an enlarged front view of an operating panel of a conventional automatic heating apparatus.
Figure 3:
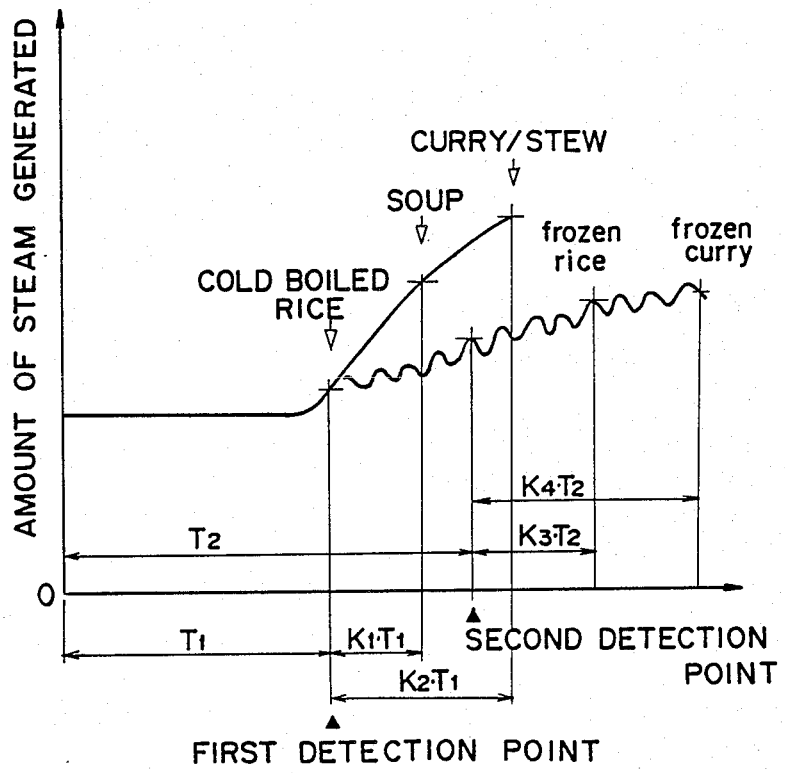
Fig. 3 PRIOR ART
FIG. 3 is a graph showing the control operation associated with a reheat key in the conventional automatic heating apparatus of FIG. 2.

Before the description of the present invention proceeds, it is to be noted that like parts are designated by like reference numerals throughout the accompanying drawings.

Figure 4:
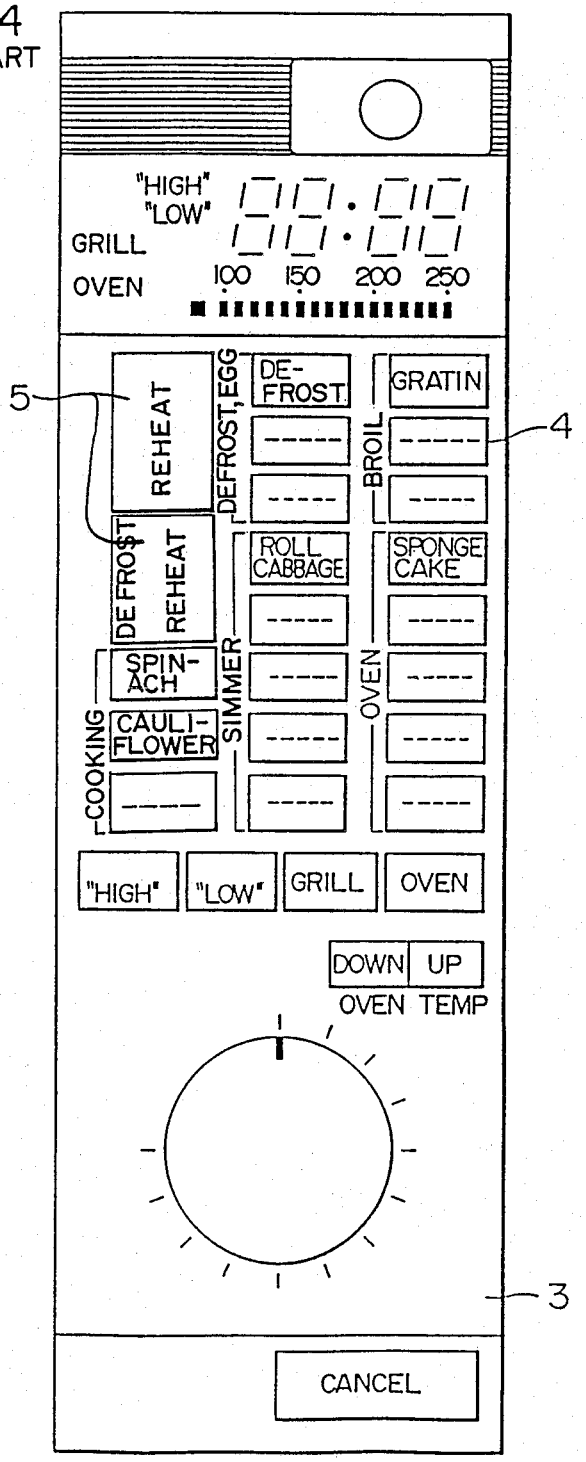
FIG. 4 PRIOR ART
FIG. 4 is a front elevational view of an operating panel, on an enlarged scale, of a conventional heating apparatus.
Figure 5:
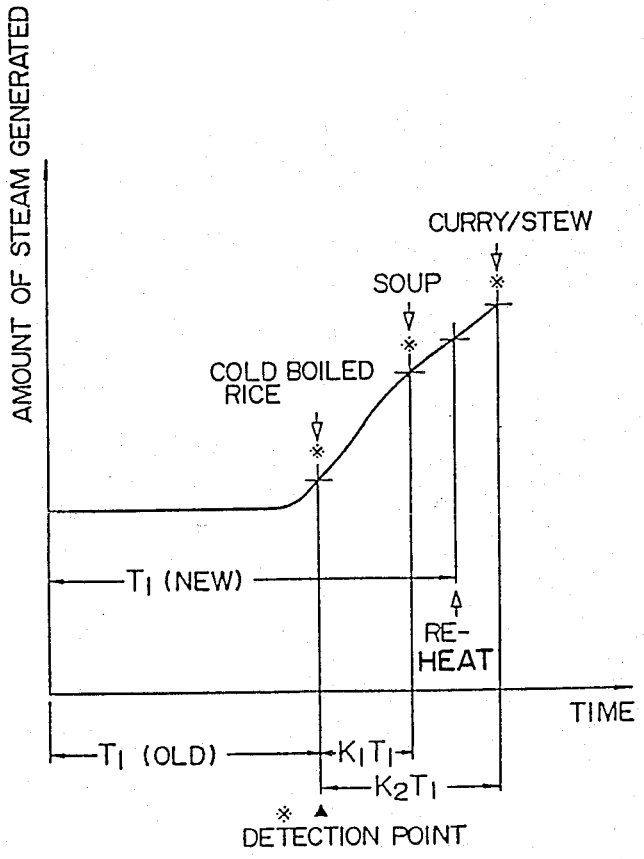
FIG. 5 PRIOR ART
FIG. 5 is a graph showing the control operation associated with a reheat key for a cold food group in a conventional automatic heating apparatus.
Figure 6:
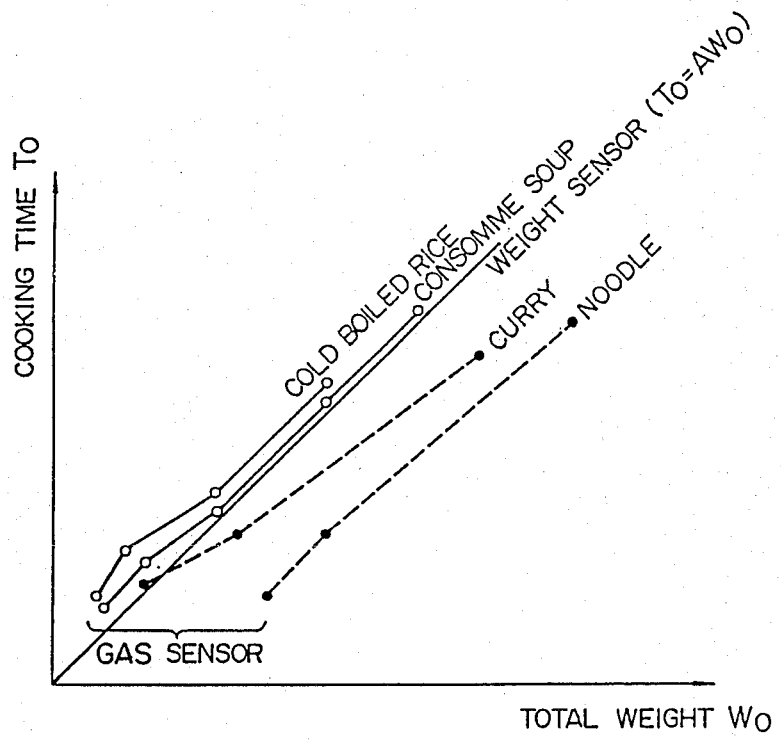
FIG. 6 PRIOR ART
FIG. 6 is a graph showing control values used in the operation of the conventional automatic heating apparatus shown in FIG. 5.
Figure 7A:
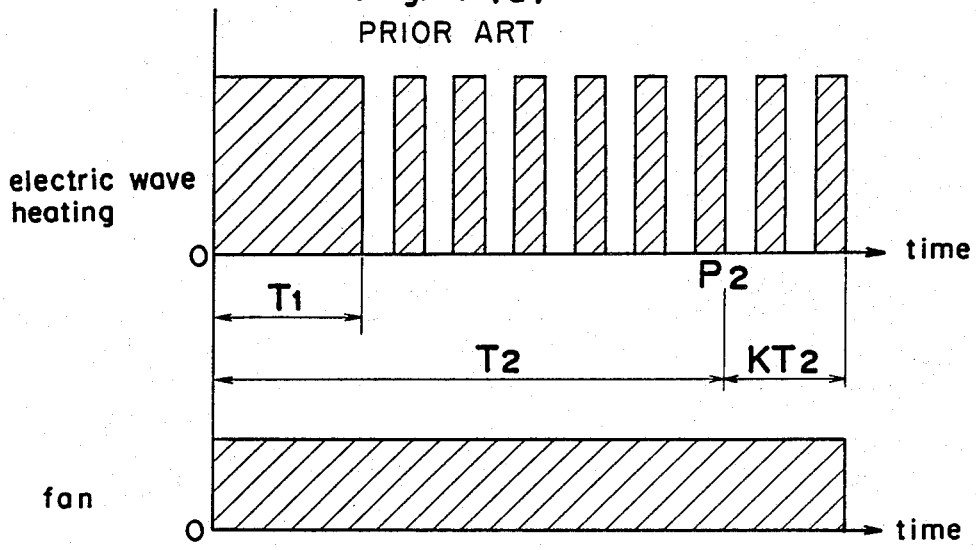
Fig. 7(a) PRIOR ART
FIGS. 7(*a*) and 7(*b*) are graphs showing a control operation associated with a reheat key for the frozen food group in a conventional automatic heating apparatus.
Figure 7B:
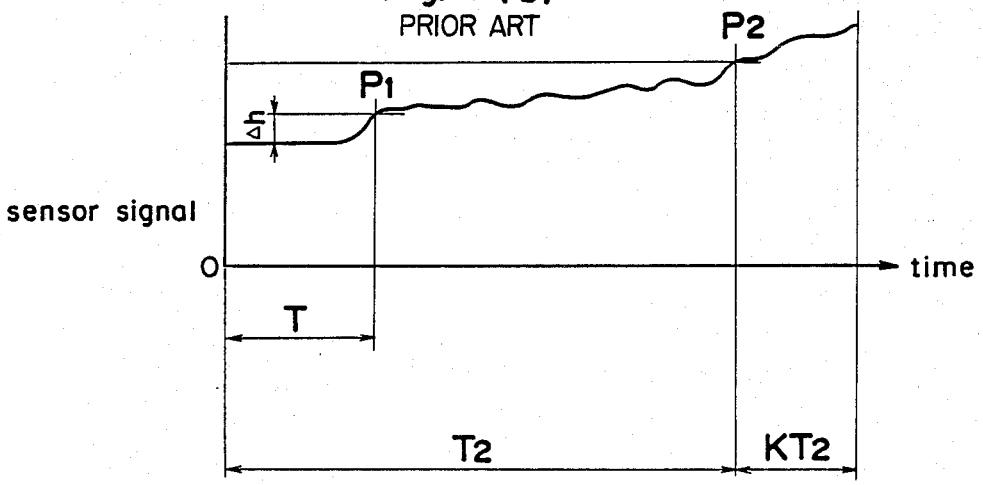
Fig. 7(b) PRIOR ART
Figure 8:
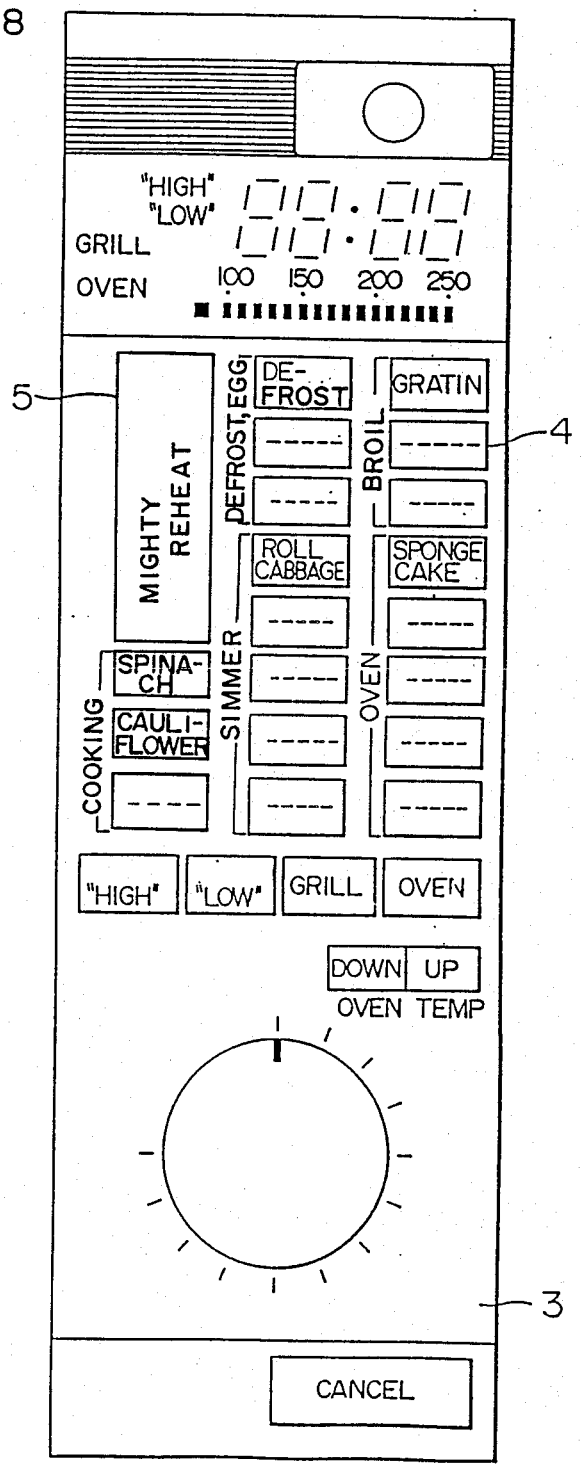
FIG. 8 is a front elevational view, on an enlarged scale, of an operating panel of an automatic heating apparatus according to one preferred embodiment of the present invention.

With reference to FIG. 8, essentially showing an operating panel of the automatic heating apparatus of the present invention, various select keys 4 are arranged on the operating panel 3. Reheating is performed by the depression of a single "mighty reheat" key 5. Although two reheat keys are provided in the prior art devices for the cold food group and the frozen food group, respectively (referring to FIG. 4), a single "already-cooked reheat" key 5 is employed for both the cold food group and the frozen food group according to the present invention. The reason for this will be made clear hereinbelow.

Figure 9A:
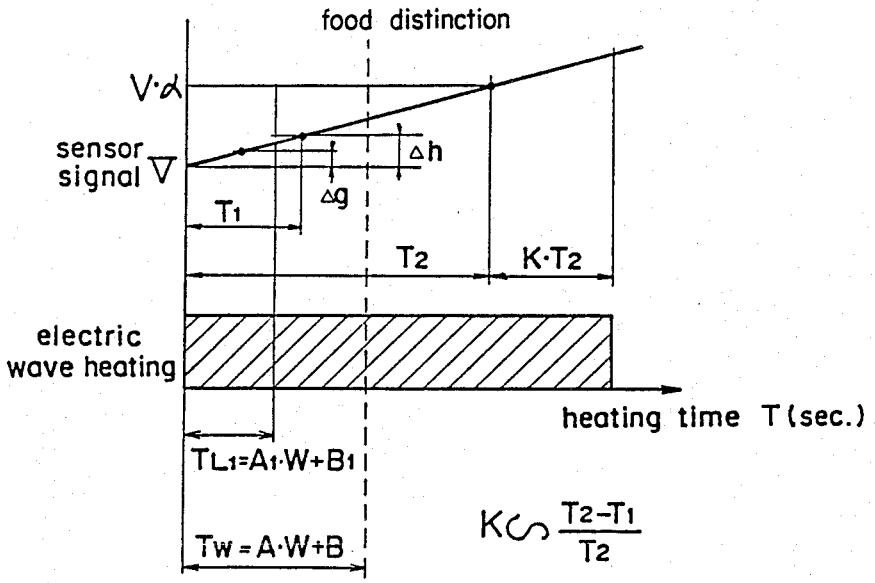
Fig. 9(a) PRIOR ART
FIGS. 9(*a*) and 9(*b*) are graphs further showing the control operation associated with the reheat key on the panel of the automatic heating apparatus shown in FIG. 8.
Figure 9B:
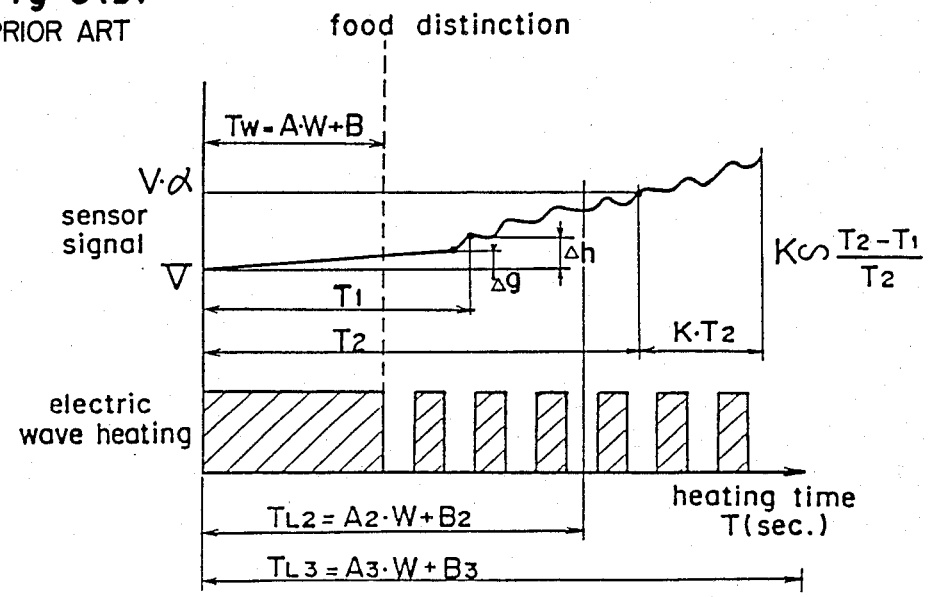
Fig 9(b) PRIOR ART
Figure 10A:
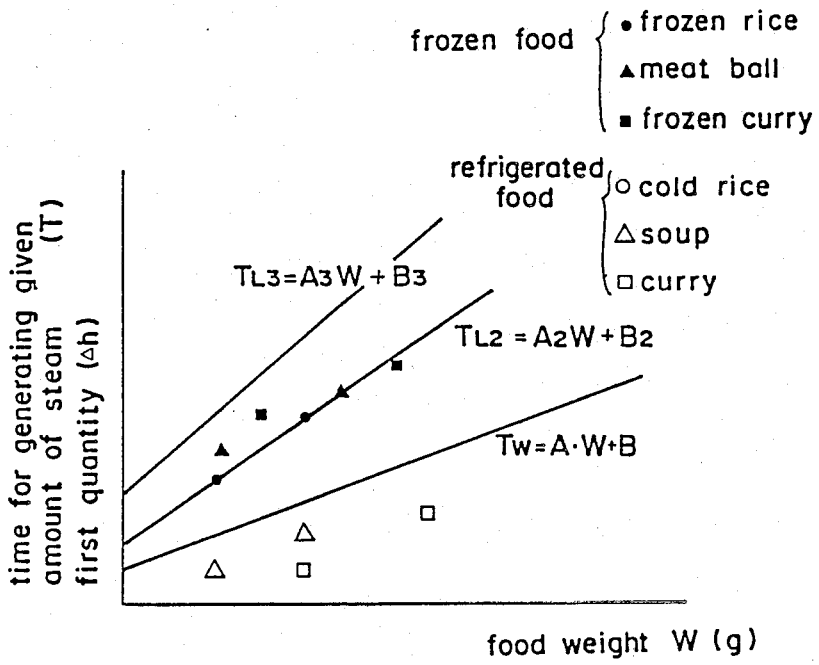
FIGS. 10(*a*) and 10(*b*) are graphs by which the group of food to be reheated is determined in the automatic heating apparatus of the present invention.
Figure 10B:
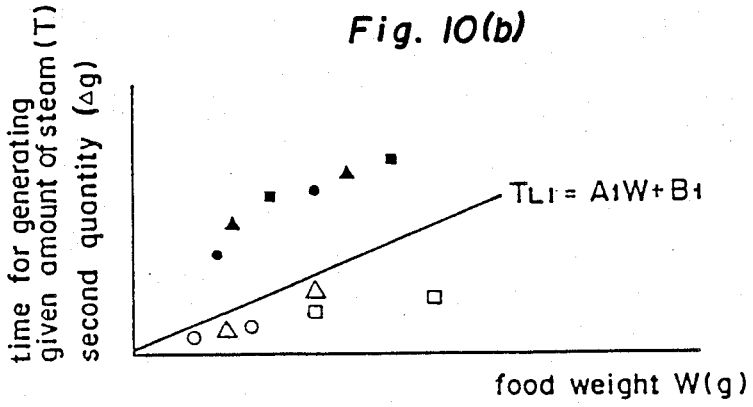

The automatic heating apparatus of the present invention is provided with two sensor means. The first sensor means is a weight sensor which detects the total weight of the food (including the package). One example of such a weight sensor is manufactured by the assignee of the present application, Matsushita Electric Industrial Co., Ltd., and has the form of an air condenser having two ceramic base plates attached with metallic films, so that the metallic films are opposite to each other through an air layer. In the Matsushita weight sensor, the capacity of the condenser is changed in accordance with the weight. Thus, the total weight of the food to be heated is detected by the first sensor means when the heating of the food is started, and the time value Tw is calculated on the basis of the detected weight. On the other hand, the second sensor means is a gas sensor which detects gas or steam generated from the food. The gas sensor is, for example, a specific humidity sensor "Neo-humi-SERAM", manufactured by Matsushita Electric Industrial Co., Ltd., or a gas sensor manufactured by Le Figaro. FIG. 9 shows the amount of gas or steam detected by the gas sensor and the time at which the food is weighed by the weight sensor, etc. Specifically, FIG. 9(*a*) shows the case where the cold food group is heated, and FIG. 9(*b*) shows the case where the frozen food group is heated. The operation common to both cases is that the total weight of the food is detected when the food is started to be heated, and it is sequentially monitored as to whether the amount of steam generated from the food before the time point Tw calculated on the basis of the detected total weight of the food is changed, as indicated by the signal level of the gas sensor, from the initial value V by the amount $\Delta g$ or by the amount $\Delta h$. If the change in amount is $\Delta h$ at the time point Tw, the food to be heated is judged to be the cold food group, and the food is continuously heated as it is. On the other hand, if the change in the amount does not reach Δh at the time point Tw, the food to be heated is determined to be the frozen food group, and the heating caloric value is switched and then the food is continuously heated. By noting the time period Tw determined by the total weight of the food, the food can be classified as in the group of cold foods or in the group of frozen foods, because it has been made clear from experiments that, as shown in FIG. 10(*a*), the cold food group undergoes the change Δh earlier than the calculated time point $Tw=A\times W+B$, while the frozen food group undergoes the change Δh later than the time point $Tw=A\times W+B$. Logically explaining the above-described phenomenon, even when the cold food group and the frozen food group having the same weight are heated by the same heating caloric value, the initial temperature of the food is different, that is, the temperature of the frozen food group is below the freezing point, whereas that of the cold food group is above 0° C., and even if the cold food group is placed in a refrigerator, the temperature thereof is about 5° C. Consequently, an accumulative heating caloric values necessary for raising the initial temperatures of the food groups to the boiling point at which the steam is generated from the food groups are different from each other, and the time period representing the accumulative heating caloric value is longer in the frozen food group than in the cold food group. As can be seen from above, according to the present invention, the food to be heated can be classified as in the cold food group or as in the frozen food group in the same heating sequence, and therefore a single select key can perform automatic reheating of various kinds of foods such as "cold boiled rice", "soup", "curry/stew", "frozen rice" or "frozen curry".

Experiments shown that the calculation formula for identifying the food to be heated on the basis of the weight thereof can be expressed by a linear expression: $Tw=A\times W+B$ wherein constant A is optimally about 0.25, and constant B is optimally be about 30, with Tw being seconds, w being grams, and B being seconds. Even when the total weight of the cold food is ±200 g from that of the frozen food because of the weight difference of the packaging, the food is correctly identified. Therefore, by making use of the linear expression, the food can be heated in a manner suitable therefor.

The structure of the automatic heating apparatus of the present invention will now be described.

Figure 11:
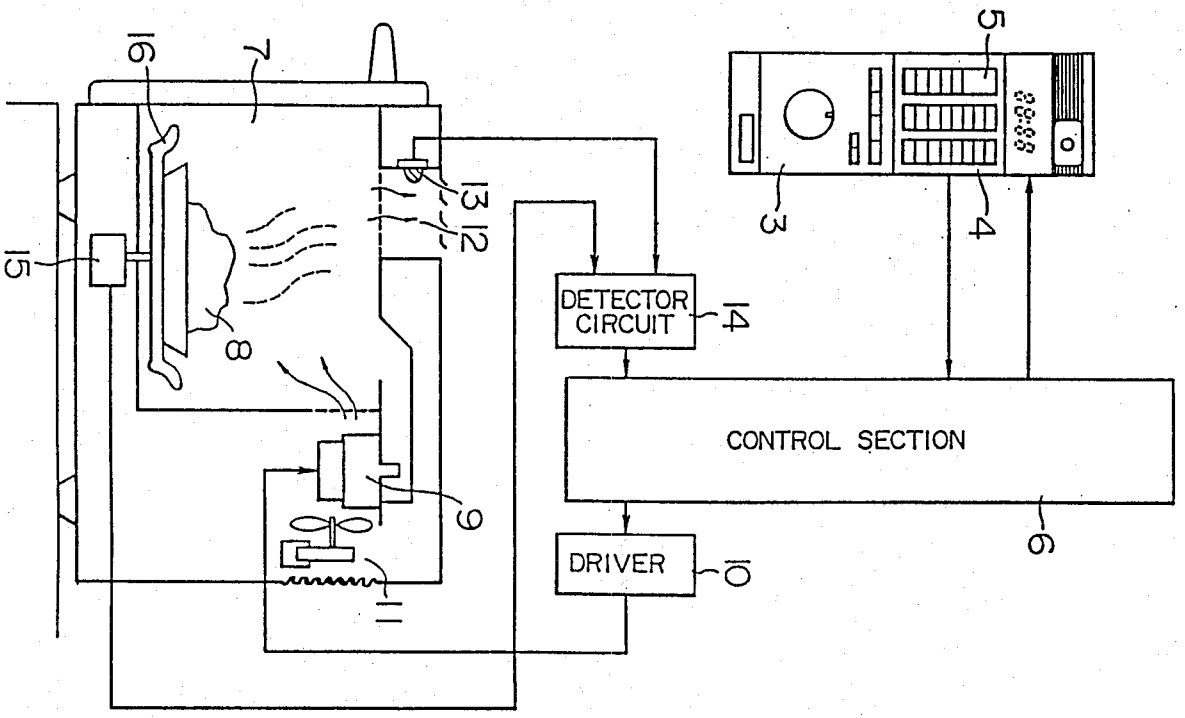
FIG. 11 is a schematic diagram of the automatic heating apparatus of the present invention.

Referring to FIG. 11, various commands inputted through the depression of the select key 4 on the operating panel 3 are read in a control section 6 to be displayed in a predetermined manner, thus controlling the heating. Reference numeral 5 indicates a "reheat" key.

Food 8 to be heated is placed in a heating chamber 7 and is heated by a magnetron 9 which is a high-frequency generating means. The supply of power to the magnetron 9 is controlled by the control section 6 through a driver 10. A fan 11 is provided to cool the magnetron 9 and at the same time ventilate the heating chamber 7. In an exhaust guide 12, for discharging the exhaust from the apparatus, is provided the second sensor means, namely, a gas sensor 13 which detects gas or steam generated from the food, thereby issuing information indicative of the state of the food as it is heated to the control section 6 through a detector circuit 14.

In the meantime, the automatic heating apparatus of the present invention is also provided with the first sensor means, i.e., a weight sensor 15, which detects the total weight of the food 8 on a platform 16. The control section 6 comprises microcomputers. The gas sensor 13, which makes use of the fact that an electric characteristic such as the resistance value of a sensor element or the capacity of a condenser is changed as the density or the amount of the liquid component of the steam and an aromatic organic gas or an aromatic inorganic gas, etc. in the air is changed, can comprise the specific humidity sensor manufactured by Matsushita Electric Industrial Co., Ltd. or Tokyo Shibaura Co., Ltd., or the gas sensor produced by Le Figaro. A pressure gauge of an air condenser system manufactured by Matsushita Electric Industrial Co., Ltd. may be employed as the weight sensor 15.

Although the calculation formula for obtaining the detection time is a linear expression $Tw=A\times W+B$ (A and B are constants) in the present embodiment, an expression of a higher degree can be selected. Further, it is needless to say that the value of the level Δh is peculiar to the apparatus, and the most suitable value may be selected for each apparatus.

Figure 12:
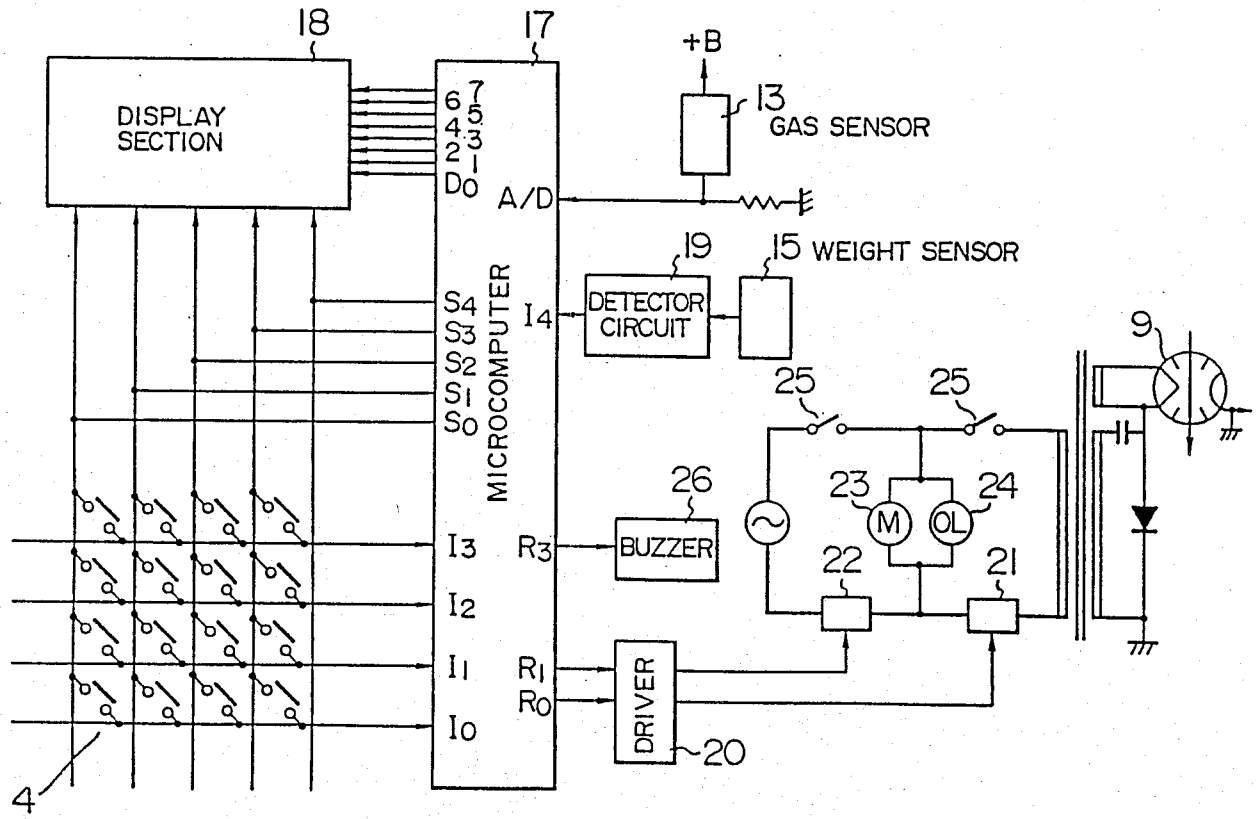
FIG. 12 is a circuit diagram of the apparatus of FIG. 11.

FIG. 12 is a circuit diagram showing the construction of the control circuit which is controlled by a microcomputer 17. A command inputted from the select key 4 to input terminals I0–I3 of the microcomputer 17 is decoded in the microcomputer 17, so as to generate a predetermined output. For example, when the "reheat" key is depressed, the microcomputer 17 makes causes "A1" to be displayed in a display section 18. The display section 18 is dynamically turned on in order to decrease signal lines. Lighting data is outputted to data outputs D0–D7 and a digit control signal is outputted to digit outputs S0–S4. The digit control signal is also used for sweeping of the key matrix 4. An output of the gas sensor 13 is inputted to an A/D conversion input terminal A/D of the microcomputer 17 in which the change of the resistance value as a result of the change in the amount of steam is measured. Moreover, an output of the weight sensor 15 is, through a detection circuit 19, inputted to the input terminal I4 of the microcomputer 17. The detector circuit 19 is formed by an oscillation circuit and a bridge circuit, etc.

Upon the starting of heating, relay control outputs R0 and R1 output signals from the microcomputer 17 through a driver 20. A relay switch 21 controls the microwaves output through an intermittent operation thereof, and a relay switch 22 controls the supply of electricity to the heating apparatus. The magnetron 9 serves to generate the microwaves introduced into the heating chamber. There are also provided in the automatic heating apparatus a motor 23 for the cooling fan, etc., a light 24 inside the apparatus, a door switch 24 operated concurrently with the opening or closing of the door member, and a buzzer 26 for notifying the user of the end of heating or the like.

Figure 13:
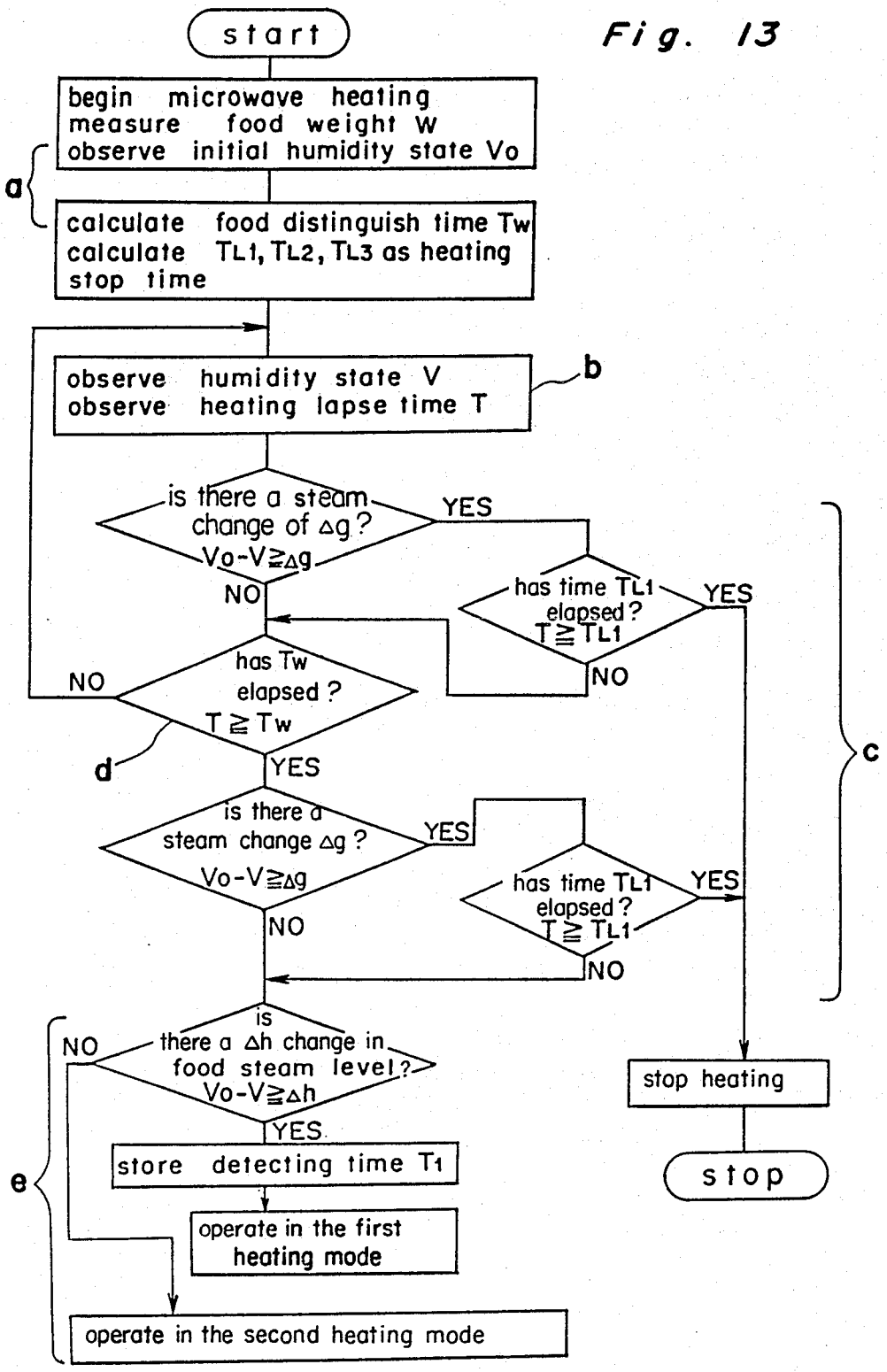
FIGS. 13 and 14 are flow-charts of the control program of the apparatus of FIG. 11.
Figure 14:
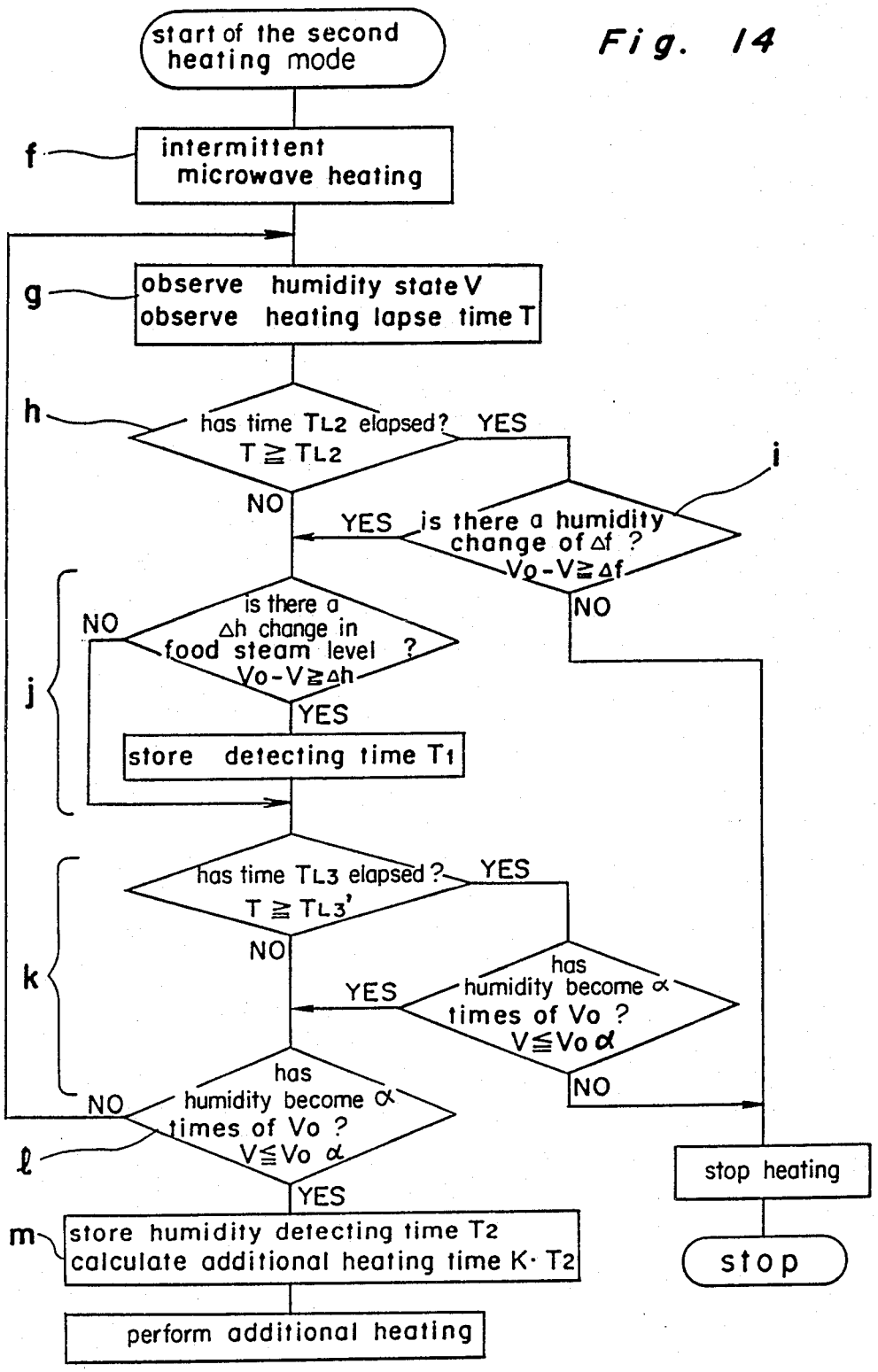

FIGS. 13 and 14 are flow-charts of the control program. First, the microcomputer 17 and the control circuit are initially programmed. Then, the display decoder operates in the manner explained with reference to FIG. 12. Thereafter, it is determined as to whether cooking is being carried out. If cooking is not being performed, an inputted key is read. When the "reheat" key is selected, with the food to be heated inside the heating chamber, and the "heating start" key is depressed, then heating is started. Simultaneously, the weight (Wg) and the initial humidity condition (V0 level) of the food to be heated are detected by the weight sensor and the gas sensor, respectively. Then, three heating stop time periods, TL1, TL2 and TL3, together with an identification time period Tw for selecting the heating mode in accordance with the condition of the food, are calculated (a). Meanwhile, upon the start of heating, the humidity condition (V) is monitored, and also the elapsed time (T) is continuously checked (b). In order to stop heating food in the cold food group such as cold boiled rice that is easy to warm and generates steam quickly, within the heating stop time period TL1 calculated on the basis of the food weight it is determined as to whether the amount of steam generated from the food is changed by the amount Δg from a change in the signal level of the gas sensor. When the humidity change Δg is detected, with the time period TL1 having lapsed, heating is immediately stopped (c). At this time, if either one of the above conditions is not satisfied, that is, if the humidity change Δg is not detected or the time period TL1 has not lapsed, heating is not stopped, but, it is determined as to whether the elapsed time T is the time period Tw which is obtained on the basis of the food weight (d) (1–3 amounts are designated for Δg). When the elapsed time T is greater than the time T2, it is determined as to whether the food has been heated so much that the steam generated from the food changes the signal level of the gas sensor by Δh, or whether the amount of the generated steam is too small to change the signal by the amount Δh. As a result, one of the first and second heating modes for the frozen food group is selected (e) (5–12 amounts are assigned for Δh). In the manner described above, the food is classified by detecting whether the change Δh in the signal level of the gas sensor has occurred at the time period Tw initially determined on the basis of the food weight.

According to the second heating mode for the frozen food group, microwaves are intermittently generated as shown in FIG. 14 at (f). The humidity condition (V), the elapsed time (T), etc. are monitored (g). It is determined as to whether or not the elapsed time (T) is beyond the heating stop time TL2 which is calculated on the basis of the food weight W (h). A change in signal value f is determined for food which has been heated over the time TL2 when reheated and generates too small of an amount of steam to change the signal level to f. In other words, the value of f is set to prevent a dangerous state in which food which is too dry or unfit for reheating is kept heating until it is scorched or is set on fire. In the case where the signal level of the gas sensor is changed by the amount f, heating is continued. However, if the signal level of the gas sensor is not changed by the amount f, the food is regarded to be in a dangerous condition and is stopped being heated (i) (2–5 levels are selected for f). When heating food in the frozen food group, the time when the change h in the signal level of the gas sensor is detected as the food is heated is memorized as the first detection time point T1 (j), with an aim that when the elapsed time is compared with the time TL3 calculated on the basis of the food weight, it can be judged that either the food is heated enough to begin automatic heating and cooking or that not enough steam has been generated from the food and thus the food is not ready for automatic heating and cooking in spite of the change Δh observed in the signal level of the gas sensor. If a sufficient amount of steam is not generated from the food, heating is stopped in order to prevent the food from being heated too much and becoming scorched or set on fire (k). If the time period TL3 has not lapsed, the food is additionally heated if before the second detection point the signal level of the gas sensor is α times of the initial value V0, with the generated steam filling the heating chamber (l). The time elapsed prior to the second detection point is memorized as T2. The time factor K for setting an additional heating time is calculated on the basis of the ratio of the time lag (T2–T1) between the first detection point T1 and the second detection point T2 with respect to the elapsed time period T2, so that the additional heating time is obtained by the product of the elapsed time period T2 and the factor K (m). Thus, heating is continued for the additional heating time K×T2, to complete heating of the frozen food in the second heating mode.

Although heating is carried out slowly by the intermittent supply of electromagnetic waves in the second heating mode described above, it goes without saying that the food to be heated can be heated with small amounts of heat such as that provided by an electric heater or due to gas combustion, thereby heating whole the whole frozen food in a moderate manner.

Moreover, also in the case of reheating the cold food in the first heating mode, for identifying the kind of the food to be heated, an additional heating time factor K is calculated based on the ratio of the time lag (T2–T1) between the first detection point T1, set when the change Δh in the signal level of the gas sensor due to the steam generated from the food is observed, and the second detection point T2, set when the change in the signal level of the gas sensor due to the generation of steam from the food becomes α times of the initial value V, to the time period T2. Then, the additional heating time K×T2 is obtained by the product of the calculated additional heating time factor K and the elapsed time T2. After heating the food over the additional heating time, heating is stopped at least.

Since the additional heating time K×T2 is calculated based on the time lag between the first detection point and the second detection point, which time lag is depends on the type and amount of food and the condition of the container of the food, the additional heating time K×T2 can be determined to correspond to the condition of the food, whether it is cold food or frozen food.

The additional heating time factor K calculated on the basis of the ratio (T2–T1)/T2 reflects the condition of the food as follows. The time lag between the first detection point and the second detection point reflects either that the food to be heated exhibits low heat conductivity and needs a long time to be totally heated or that the food is heated fast in a short time. Further, when the food is covered with a wrapping made of a transparent resinous film, a large amount of time elapses before enough steam is generated from the food and gathered to break the wrapping after the food gets warm, and a large amount of steam is generated in the apparatus all at once after the wrapping is broken. Accordingly, the time lag between the first detection point and the second detection point becomes small. On the contrary, without the wrapping, the steam is gradually generated in accordance with the temperature rise of the food, and therefore the first detection point is established in a short time, resulting in a large time lag between the first detection point and the second detection point. As described above, the time lag differs depending on whether the food is wrapped or by the heat conductivity exhibited by the food, etc. Moreover, when the total weight of the food is large, the time before steam is generated from the food is long. Therefore, if only the time lag between the first detection point and the second detection point is taken into consideration, it is difficult to determine what the time lag resulted from, namely, from the food generating a large amount of steam per unit weight or from the food being heated rapidly. Because of the above fact, the time period T2 prior to the second detection point is employed for reflecting the total weight of the food, and the ratio of the time lag between the first detection point and the second detection point with respect to the time elapsing before the second detection point is calculated. Accordingly, the ratio can be regarded as a characteristic value of the food taking into consideration the material, condition, and total weight of the food. Thus, the calculation of the factor K can be said to categorize the object based on the above factors.

As is made clear from the foregoing description, the automatic heating apparatus of the present invention exhibits the following effects and has the following merits.

(1) The auotmatic heating apparatus employs both the gas sensor and the weight sensor, so that the change in the signal level of the gas sensor from the initial level thereof at the start of heating is detected at a predetermined time calculated on the basis of the weight of the food (including the packing), so as to check for the presence of a large change in the signal level that is over a predetermined value. Thus, reheating can be performed only by depressing a signal "mighty reheat" key. Accordingly, a user of the apparatus need not be concerned and cannot make a mistake as to which key he or she should select, and therefore the operating efficiency is remarkably improved. Nevertheless, the finished menus facilitate the many advantages of the conventional heating apparatus having 4–5 select keys.

(2) The poor correspondence to the weight of food of the gas or steam sensed by the gas sensor is overcome by employing the weight sensor. Therefore, heating can be controlled to be stopped even when a small increase in the amount of steam generated from the food is detected at the time calculated on the basis of the total weight of the food detected by the weight sensor, thereby preventing overheating of food that generates only a little steam.

(3) Even when the amount of steam generated from the food is not sufficient to change the signal level of the gas sensor to a predetermined change in level despite the weight of the food being enough, or the signal level of the gas sensor is not changed due to a breakage of the gas sensor, i.e., even under particular conditions for automatic heating, the food can be prevented from being overheated and scorched. Moreover, even when the apparatus is idly driven without any food placed in the heating chamber, since no change would be brought about in the signal level of the gas sensor corresponding to a predetermined change before the predetermined time calculated on the basis of the weight detected by the weight sensor, heating is safely stopped in quite a short time. (4) Even when the food weighs enough, and the signal level of the gas sensor is changed by the generated steam to a predetermined first level change, but not to a second level change, namely, even when dry food is heated or a frozen meat bun contained in a large heavy container is heated, under particular conditions for automatic heating, overheating and scorching of the food can be prevented since heating is stopped in part due to the time calculated on the basis of the food weight. Further, even when noises from outside such as microwaves of the heating apparatus, discharging noises of a relay contact or induction surge noises of the transformer or motor propagate to the control section during heating, and consequently a normal change in the signal level of the gas sensor is not transmitted to the control section, heating is stopped in part due to the time calculated on the basis of the food weight until the signal level of the gas sensor reaches the level at the second detection point (impossible level). Thus, the automatic heating apparatus of the present invention is safe.

As has been described hereinabove, the present invention has operating keys that are relatively simple, due to intensive functions, in the heating apparatus provided with a gas sensor and a weight sensor such as an electronic oven, an electric oven, a combination oven, or a gas oven. Moreover the heating apparatus according to the present invention is provided with sensors, not a single sensor, so as to detect the condition of the food to be heated over time, so that the heating time can be controlled properly to prevent the overheating of the food. As a result, the heating apparatus of the present invention exhibits a relatively high degree of safety.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An automatic heating apparatus comprising:

a heating means for heating an object, said heating means operable in a plurality of different heating modes;

a first sensor means for detecting the weight of an object;

a second sensor means for detecting the amount of gas or steam generated by an object as the object is heated by said heating means;

a control means operatively connected to said heating means, said first sensor means and said second sensor means for performing a heating controlling operation during which said control means controls said heating means to operate in one of said heating modes by selecting said one of said heating modes based on the weight detected by said first sensor means and the amount of gas or steam detected by said second sensor means;

an input means operatively connected to said control means for inputting a command to said control means to initiate said heating controlling operation; and said control means including a calculation means for calculating a detection time period based on the weight of an object detected by said first sensor means at the initiation of said heat controlling operation, a timer means for measuring the time that has lapsed from the initiation of said heating controlling operation, a comparison means for comparing the change in the amount of steam or gas detected by said second sensor means from the initiation of said heating controlling operation until said detection time period lapses with a predetermined value, identification means for categorizing the object based on the comparison made by said comparison means, and selecting means for selecting one of said heating sequences based on the categorization of the object by said identification means.

2. An automatic heating apparatus as claimed in claim 1, wherein said second sensor means is a humidity sensor for detecting absolute humidity.

3. An automatic heating apparatus as claimed in claim 1, wherein said control means performs said heating controlling operation based on the entire weight of the object disposed in the apparatus.

4. An automatic heating apparatus as claimed in claim 1, wherein said calculation means calculates said detection time period based on the following equation $$Tw = A \times W + B$$

wherein Tw is said detection time period, A and B are constants and W is the weight of the object detected by said first sensor means.

5. An automatic heating apparatus as claimed in claim 1, wherein said identification means categorizes the object on the basis of the material thereof, characteristics exhibited by the object associated with the heating thereof, and the weight of the object.

6. An automatic heating apparatus as claimed in claim 5, wherein said identification means categorizes the object by calculating three time periods at which a heated state of the object is evaluated, said time periods defined by the equations $$TL1 = A1 \times W + B1$$

$$TL2 = A2 \times W + B2$$

$$TL3 = A2 \times W + B3$$

wherein TL1, TL2 and TL3 are said time periods, respectively, A1, A2, A3, B1, B2 and B3 are constants and W is the weight of the object detected by said first sensor means.

7. An automatic heating apparatus as claimed in claim 1, wherein said identification means stores a first detecting time T1 when the object obtains a first predetermined state while being heated, stores a second detecting time T2 when the object obtains a second predetermined state while being heated, and assigns a characteristic factor to the object based on the ratio of the time lag between when the second and the first detecting times are stored to the second detecting time, and said control means causes the object to be heated an additional time equal to the product of said factor and T2.

8. An automatic heating apparatus as claimed in claim 1, wherein said heating modes include a heating mode in which said heating means is operated continuously, and a heating mode in which said heating means is operated intermittently.

9. A method of controlling the operation of a heating means of an automatic heating apparatus having a heating chamber in which an object is placeable to be heated by the heating means and a select key for initiating the operation, said method comprising the steps of:

obtaining an initial weight of the object placed in the heating chamber of the automatic heating apparatus;

heating the object with said heating means;

monitoring the amount of steam or gas generated by the object as the object is heated;

calculating a detection time period based on the initial weight of the object obtained, comparing the change in the amount of steam or gas generated by the object from the initiation of the heating of the object until the detection time period lapses with a predetermined value; and selecting a heating mode with which to control the operation of said heating means from among a plurality of heating modes based on the comparison made with said predetermined value.

* * * * *